US008143803B2

(12) United States Patent
Beij et al.

(10) Patent No.: US 8,143,803 B2
(45) Date of Patent: Mar. 27, 2012

(54) LAMP CONTROL CIRCUIT AND METHOD OF DRIVING A LAMP

(75) Inventors: Marcel Beij, Eindhoven (NL); Johannes Petrus Wernars, Oss (NL); Jozef Johannes Maria Hulshof, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 626 days.

(21) Appl. No.: 12/302,300

(22) PCT Filed: May 31, 2007

(86) PCT No.: PCT/IB2007/052042

§ 371 (c)(1),
(2), (4) Date: Nov. 25, 2008

(87) PCT Pub. No.: WO2007/141713

PCT Pub. Date: Dec. 13, 2007

(65) Prior Publication Data

US 2009/0167204 A1 Jul. 2, 2009

(30) Foreign Application Priority Data

Jun. 2, 2006 (EP) ..... 06114902

(51) Int. Cl.
*H05B 37/02* (2006.01)

(52) U.S. Cl. ..... 315/291; 315/297; 315/307

(58) Field of Classification Search ..... 315/149, 315/151, 157–159, 291, 294, 297, 307
See application file for complete search history.

(56) References Cited

U.S. PATENT DOCUMENTS

| | | | | |
|---|---|---|---|---|
| 6,693,397 | B2 | 2/2004 | Handa et al. | |
| 7,358,679 | B2 * | 4/2008 | Lys et al. | 315/51 |
| 2002/0084890 | A1 | 7/2002 | Guerrieri et al. | |
| 2003/0057887 | A1 * | 3/2003 | Dowling et al. | 315/291 |
| 2003/0137258 | A1 * | 7/2003 | Piepgras et al. | 315/291 |
| 2003/0155869 | A1 | 8/2003 | Mollema et al. | |
| 2003/0222587 | A1 * | 12/2003 | Dowling et al. | 315/149 |
| 2005/0151489 | A1 * | 7/2005 | Lys et al. | 315/308 |
| 2005/0231133 | A1 * | 10/2005 | Lys | 315/291 |
| 2005/0236998 | A1 * | 10/2005 | Mueller et al. | 315/51 |
| 2006/0275040 | A1 * | 12/2006 | Franklin | 398/172 |

FOREIGN PATENT DOCUMENTS

| | | | |
|---|---|---|---|
| DE | 202005006465 | U1 | 7/2005 |
| DE | 102004039677 | A1 | 12/2005 |

(Continued)

*Primary Examiner* — Tung X Le
(74) *Attorney, Agent, or Firm* — Mark L. Beloborodov

(57) ABSTRACT

In a method of driving a lamp using a lamp control circuit, the lamp control circuit comprises a communication circuit and a lamp driving circuit. The lamp driving circuit is configured to drive a lamp in accordance with a number of lamp operating parameters. The method comprises providing a lamp operating parameter to a memory of the communication circuit; providing a supply voltage to the lamp driving circuit; and supplying the lamp operating parameter from the memory to the lamp driving circuit. Then, driving the lamp by the lamp driving circuit corresponding to the supplied lamp operating parameter In the lamp control circuit, the communication circuit comprises a memory and is configured to supply the lamp operating parameter to the lamp driving circuit, when the lamp driving circuit is supplied with a supply voltage. In an embodiment, the lamp operating parameter may be supplied to the memory when no supply voltage is supplied to the lamp control circuit.

7 Claims, 2 Drawing Sheets

FOREIGN PATENT DOCUMENTS

| | | | |
|---|---|---|---|
| JP | 2002305088 | A | 10/2002 |
| JP | 2005183050 | A | 7/2005 |
| WO | 9620369 | A1 | 7/1996 |
| WO | 2005107337 | A1 | 11/2005 |

* cited by examiner

LAMP CONTROL CIRCUIT AND METHOD OF DRIVING A LAMP

FIELD OF THE INVENTION

The present invention relates to a lamp control circuit and a method of driving a lamp.

BACKGROUND OF THE INVENTION

For illuminating large spaces or objects, such as in road lighting applications, a number of lamps is used, which together illuminate the space or objects. A lighting condition at a first location may however be desired to be different at a second location. Therefore, a lamp operating parameter of a first lamp may be selected to be different from a lamp operating parameter of a second lamp.

In road lighting applications, for example, a road may be illuminated during nighttime and/or during specific weather conditions. Usually, lamps used for road lighting are on or off. However, for energy saving, i.e. energy consumption reduction, road lighting may be dimmed during low traffic hours and/or during dusk and dawn and/or other predetermined conditions. Whether a lamp of the road lighting is dimmed may be dependent on the location of the lamp. For example, a lamp for lighting a highway (motorway), a main road or a street may require different settings, i.e. at least one different operating parameter. Further, a lamp near a street section may require a different setting compared to a lamp near a straight part of that street. Hence, each lamp may need its own settings, i.e. set of lamp operating parameters comprising at least one lamp operating parameter.

At a manufacturing site, a lamp control circuit comprised in a lamp system may be assembled. It is known to program the settings for each lamp in a lamp control circuit at the manufacturing site and provide each lamp system with a detectable unique code. A number of lamp systems is brought to the location where they are to be installed. Each lamp system is then selected based on the code and installed at the corresponding location. Hence, a lighting plan is to be prepared prior to installing the lamp systems, each lamp control circuit comprised in the lamp system is to be programmed according to the lighting plan at the manufacturing site and then, during installation, each preprogrammed lamp is to be installed at the corresponding location. Thus, a logistically complex installation process has to be performed for installing the e.g. road lighting systems.

After installation, in particular in road lighting applications, it is difficult to change the lamp settings, since safety regulations require that a supply voltage is disconnected from the lamp, when a housing of the lamp is opened. Consequently, it is difficult to supply new settings to a lamp driving circuit, since the lamp driving circuit is not powered.

OBJECT OF THE INVENTION

It is an object of the present invention to provide a lamp and in particular a lamp control circuit that allows a logistically simple installation process.

SUMMARY OF THE INVENTION

The present invention provides a method of driving a lamp using a lamp control circuit. The lamp control circuit comprises a communication circuit and a lamp driving circuit. The method comprises providing a lamp operating parameter to a memory of the communication circuit; providing a supply voltage to the lamp driving circuit; supplying the lamp operating parameter from the memory to the lamp driving circuit; and driving the lamp by the lamp driving circuit corresponding to the supplied lamp operating parameter.

In the method according to the present invention, the settings, i.e. at least one lamp operating parameter, is stored in a memory. The memory may be a kind of memory that does not require a supply voltage for storing data. Such a memory is well known in the art, e.g. a solid state memory. Consequently, the lamp control circuit does not have to be connected to a supply voltage for storing the at least one lamp operating parameter in the memory. During manufacturing, each lamp and lamp control circuit is manufactured alike and may not be provided with any settings or may be provided with a default settings. Then, each lamp control circuit may be installed at any location and may be provided with a settings upon installation, in particular, but not necessarily, prior to connecting the lamp control circuit to a supply voltage.

When the lamp control circuit is connected to the supply voltage, thereby powering the lamp driving circuit, the lamp control circuit is enabled to read a stored lamp operating parameter from the memory and supply power to the lamp in accordance with the lamp operating parameter. It is noted that in an embodiment, the lamp operating parameter(s) may as well be supplied to the memory when the lamp control circuit is powered.

In an embodiment, the communication circuit is configured for wireless communication with an external device. For example, the communication device may comprise a RFID transponder operatively connected to the memory for storing a parameter received by the RFID transponder in the memory. A RFID transponder is known in the art and may receive a communication signal without being powered, i.e. without receiving a supply voltage. Thus, a simple and cost-effective embodiment of the communication circuit is provided.

In an embodiment, the memory has a first port for a receiving an operating parameter from an external device and a second port for supplying an operating parameter to the lamp driving circuit.

In an embodiment, the communication circuit of the lamp control circuit is configured for bidirectional communication with the lamp driving circuit and an external device, thereby enabling to receive a status parameter from the lamp driving circuit, storing the status parameter in the memory and supplying the status parameter to the external device. The status parameter may be any parameter, including the lamp operating parameter previously supplied by the communication circuit. Thus, it is enabled to check the stored operating parameters and receive information on the status of the lamp and/or the lamp control circuit by receiving parameters like burning time, diagnostic parameters, etc. Receiving parameters from the lamp control circuit eases maintenance of the lamp, for example.

In an aspect of the invention, a system for controlling a lamp is provided which system comprises a lamp control circuit according to the invention; and an external control device configured for communicating a lamp operating parameter to the communication circuit of the lamp control circuit.

BRIEF DESCRIPTION OF THE DRAWINGS

These and other aspects of the invention are apparent from and will be elucidated with reference to the embodiments described hereinafter. In the drawings.

DETAILED DESCRIPTION OF EXAMPLES

Figure 1:
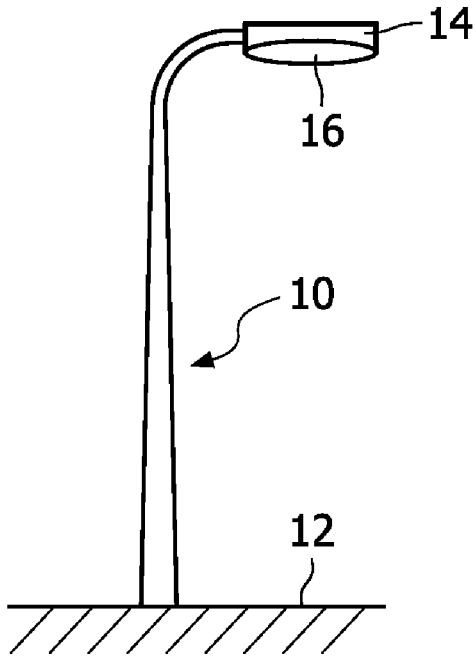
FIG. 1 shows a view of light pole for illuminating a road.

FIG. 1 shows a light pole 10 for illuminating a road 12. The light pole 10 is provided with a lamp housing 14 comprising a transparent housing compartment 16 for holding a lamp.

Figure 2:
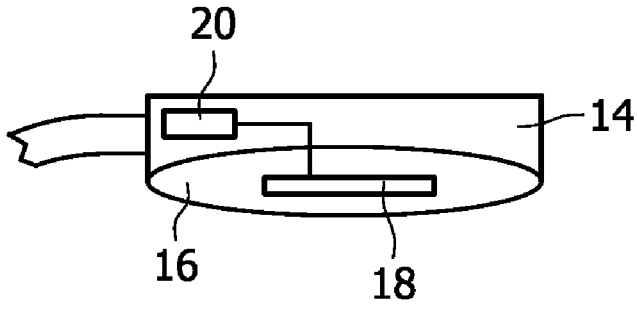
FIG. 2 schematically illustrates a lamp housing of the light pole of FIG. 1, FIG. 3 schematically illustrates a lamp control circuit according to the present invention, and FIG. 4 schematically illustrates a control device according to the present invention.

FIG. 2 shows the lamp housing 14 in more detail. The lamp housing 14 encases a lamp control circuit 20. A lamp 18 is positioned in the transparent housing compartment 16 and connected to the lamp control circuit 20 for receiving power. The lamp control circuit 20 is connected to a power supply (not shown), when the lamp housing 14 is in a closed state. When the lamp housing 14 is opened, for example for maintenance and/or replacing the lamp 18, the lamp control circuit 20 may be automatically disconnected from the power supply for safety reasons.

The lamp control circuit 20 is configured to control the light output of the lamp 18. Whereas the lamp 18 was configured to be on or off in the past, nowadays the lamp 18 may be controlled to output more or less light depending on one or more external conditions, such as the amount of traffic, weather conditions, dusk and dawn hours, etc. Thereto, the lamp control circuit 20 may be provided with predetermined settings, i.e. a set of at least one lamp operating parameters, corresponding to which the light output of the lamp 18 is controlled. The settings may be dependent on the location of the light pole 10. For example, illumination of a motorway may require different settings compared to a light pole 10 for illuminating a side street in a city. As a further example, a light pole 10 for illuminating a straight part of a street may require a different setting compared to a light pole 10 for illuminating a section or a roundabout.

The settings of a light pole 10 comprises at least one lamp operating parameter, such as a lamp current, a lamp voltage, a lamp power, possibly as a function of time or depending on a light condition of the environment, and the like. The settings is to be supplied to the lamp control circuit 20 such that the lamp control circuit 20 is enabled to control the lamp 18 corresponding to the settings, i.e. the desired lamp operating parameter(s). As different lamp operating parameters may be required for each light pole 10, each light pole 10 may be supplied with the set of lamp operating parameters corresponding to its location. At its location the lamp control circuit 20 is, however, disconnected from a power supply, when the lamp housing 14 is opened, or not yet installed, as mentioned above. Therefore, in the prior art, the lamp operating parameters are supplied at the manufacturing site.

Figure 3:
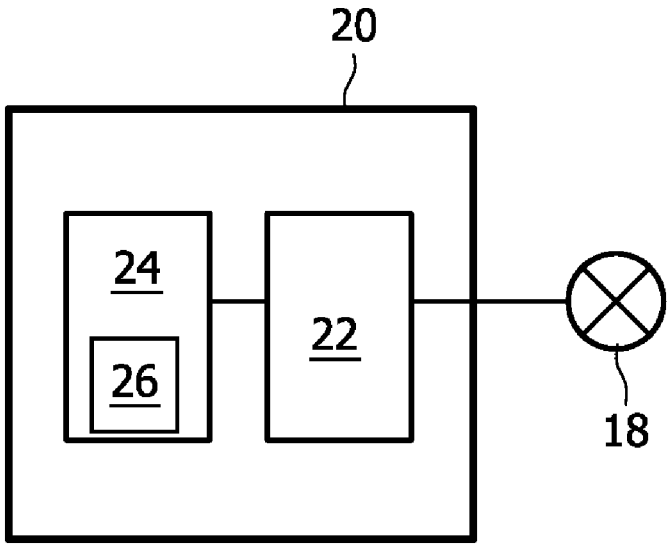

FIG. 3 schematically shows a lamp control circuit 20 according to the present invention in more detail. In order to enable to supply a lamp operating parameter at the location of the light pole 10, a lamp control circuit 20 is provided with a communication circuit 24 comprising a memory 26. A lamp driving circuit 22 is provided for supplying power to the lamp 18 corresponding to the lamp operating parameter. Under normal operation conditions, the lamp control circuit 20 is powered, i.e. supplied with a supply voltage. When the lamp housing 14 is opened, the lamp control circuit 20 may not be supplied with power for safety reasons as discussed above. Therefore, the communication circuit 24 comprising the memory 26 may be designed such that the memory 26 may receive the settings, when the communication circuit 24 is not powered.

It is noted that, in an embodiment, the memory 26 may as well receive a lamp operating parameter, when the lamp control circuit 20 is powered. In such an embodiment, the lamp control circuit 20 may be configured to operate in a normal mode or in a maintenance mode. In the normal mode, the lamp control circuit 20 is configured to drive the lamp 18 and in the maintenance mode the lamp control circuit 20 may be configured to receive and/or supply settings and/or other parameters. A person skilled in the art readily recognizes that also other methods and/or means may be provided to supply the settings from the memory 26 to the lamp driving circuit 22, if the lamp control circuit 20 is powered, when the settings is supplied to the memory 26.

The memory 26 may be a solid state memory (flash memory), which is configured to hold data such as a lamp operating parameter without being supplied with power. However, in order to receive and store data, power is required.

In an embodiment, the communication circuit 24 may be a removable circuit, such as a removable memory device known for use with a digital device such as a computer, digital camera, and the like. An example of such a memory device is a USB memory stick. The removable memory circuit may be connected to an external device, which is configured to store the lamp operating parameter in the memory 26. After having stored the lamp operating parameter, the removable memory circuit is again connected to the lamp control circuit 20. After closing the lamp housing 14, thereby powering the lamp control circuit 20, the lamp operating parameter is read from the memory 26 and supplied to the lamp driving circuit 22.

In another embodiment, the communication circuit 24 comprises a RFID transponder, which is known in the art. A RFID transponder (also known as a RFID-tag) may be activated by supplying a radio frequency (RF) signal. The RF signal may comprise data, which is to be stored in the memory 26. Further, the RF signal generates a current in the RFID transponder thereby supplying power to the communication circuit 24 such that the data may be stored in the memory 26. Thus, using a wireless communication, data may be provided to the memory 26. In an embodiment, the lamp operating parameter may be supplied to the memory 26, even when the lamp housing 14 is closed and the lamp control circuit 20 is powered. However, in order to prevent that any person may supply a lamp operating parameter, the communication circuit 24 may be configured such that the memory 26 can only be supplied with data, when the power supply is disconnected.

Figure 4:
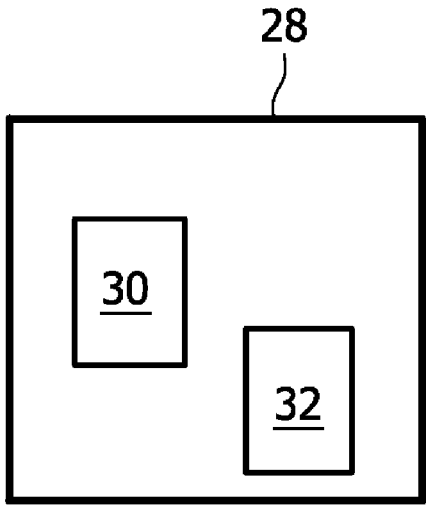

FIG. 4 shows schematically a control device 28 for supplying a lamp operating parameter to the lamp control circuit 20. The control device 28 comprises an input circuit 30 and a control communication circuit 32. The input circuit 30 is configured to receive lighting settings from an operator and may thereto comprise a keyboard, for example.

The settings comprising the lamp operating parameters are supplied to the control communication circuit 32. The control communication circuit 32 is configured for communicating with the communication circuit 24 of the lamp control circuit 20. Referring to the above-mentioned embodiments of the communication circuit 24, the control communication circuit 32 may comprise a terminal for a connection to a removable memory device and/or a RF transmitter for transmitting a RF signal.

With the lamp control circuit 20 and the control device 28 according to the present invention, the lamp operating parameter(s) may be transferred to the lamp control circuit 20, when the lamp control circuit 20 is not connected to a power supply. Thus, it is enabled to transfer the lamp operating parameters at the location of the light pole 10. Consequently, the lamp assembly comprising the lamp control circuit 20 and possibly the lamp housing 14 and a lamp 18 may be manufactured and brought to the installation location. During installing the light pole, the desired lamp operating parameters are transferred to the lamp control circuit 20. It is as well enabled to change the lamp operating parameters of the lamp control circuit 20 after installing the light pole 10.

In an embodiment, the lamp system comprising the lamp control circuit 20 and the control device 28 may be configured for bi-directional communication. In such an embodiment, the lamp operating parameters can be transferred to the lamp control circuit 20 and lamp status parameters may be transferred to the control device 28. The lamp status parameters may comprise the lamp operating parameters as stored in the lamp control circuit 20 and may comprise any other parameter that may be useful for e.g. maintenance of the lamp 18, such as burning hours and error parameters (diagnostic parameters).

While the invention has been described in relation to a light pole for illuminating a road, the invention may as well be applied in other lighting applications, such as for illuminating an interior space of a building, and the like. In particular, the present invention may be used for enabling a dimmable lighting system without requiring additional wiring. Hence, although detailed embodiments of the present invention are disclosed herein, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention.

The terms "a" or "an", as used herein, are defined as one or more than one. The term another, as used herein, is defined as at least a second or more. The terms including and/or having, as used herein, are defined as comprising (i.e., open language). The term coupled, as used herein, is defined as connected, although not necessarily directly, and not necessarily wiredly.

The invention claimed is:

1. Method of driving a lamp using a lamp control circuit, the lamp control circuit comprising a communication circuit and a lamp driving circuit, the method comprising providing a lamp operating parameter to a memory of the communication circuit;

providing a supply voltage to the lamp driving circuit; supplying the lamp operating parameter from the memory to the lamp driving circuit; and driving the lamp by the lamp driving circuit corresponding to the supplied lamp operating parameter, wherein the communication circuit is configured for receiving the lamp operating parameter when no supply voltage is supplied to the lamp driving circuit.

2. Lamp control circuit for driving a lamp, the lamp control circuit comprising a lamp driving circuit for supplying power to the lamp and a communication circuit for receiving a lamp operating parameter, wherein the communication circuit comprises a memory and is configured to supply the lamp operating parameter to the lamp driving circuit, when the lamp driving circuit is supplied with a supply voltage, wherein the communication circuit is configured for receiving the lamp operating parameter when no supply voltage is supplied to the lamp driving circuit.

3. Lamp control circuit according to claim 2, wherein the communication circuit is configured for wireless communication.

4. Lamp control circuit according to claim 3, wherein the communication circuit comprises a RFID transponder operatively connected to the memory for storing a parameter received by the RFID transponder in the memory.

5. Lamp control circuit according to claim 2, wherein the memory has a first port for a receiving an operating parameter from an external device and a second port for supplying an operating parameter to the lamp driving circuit.

6. Lamp control circuit according to claim 2, wherein the communication circuit is configured to receive a status parameter from the lamp driving circuit and to store the status parameter in the memory and is configured to supply the stored status parameter to an external device.

7. System for controlling a lamp, the system comprising:

a lamp control circuit according to claim 2;

an external control device configured for communicating an operating parameter to the communication circuit of the lamp control circuit.

* * * * *